United States Patent [19]

Rzechula

[11] Patent Number: 4,944,103

[45] Date of Patent: Jul. 31, 1990

[54] SPREADER ATTACHMENT APPARATUS

[75] Inventor: Michael J. Rzechula, Elizabethtown, Ill.

[73] Assignee: Slick Ice Limited, Elizabethtown, Ill.

[21] Appl. No.: 411,115

[22] Filed: Sep. 27, 1989

[51] Int. Cl.[5] ..... E01H 4/00

[52] U.S. Cl. ..... 37/219; 37/196

[58] Field of Search ..... 37/219, 196

[56] References Cited

U.S. PATENT DOCUMENTS

| | | | |
|---|---|---|---|
| 3,302,975 | 2/1967 | Vandenberg | 37/219 X |
| 3,622,205 | 11/1971 | Zamboni | 37/219 X |
| 4,544,304 | 10/1985 | Fisher | 37/219 X |
| 4,651,451 | 3/1987 | Beeley et al. | 37/219 |

*Primary Examiner*—Dennis L. Taylor
*Assistant Examiner*—J. Russell McBee
*Attorney, Agent, or Firm*—Wood, Phillips, Mason, Recktenwald & Vansanten

[57] ABSTRACT

A spreader attachment is provided for an ice resurfacing machine of the type having a front and rear, a laterally extending conditioning housing with a rigid frame portion to be positioned in close proximity to a subjacent surface to be treated and having associated means for delivering water from a supply against a subjacent surface, and structure for propelling the housing across a subjacent surface to be treated. The spreader attachment consists of an elongate support bar secured to the rigid frame portion so that the length of the support bar is substantially horizontally situated along the lateral extent of the housing with the support bar having a laterally extending support surface, a spreader element with an attachment surface for engagement with a subjacent surface to distribute water from the supply evenly on a subjacent surface across the lateral extent of the housing as the housing is moved, and cooperating structure on the spreader element and support bar for releasably attaching the spreader element to the support bar in operative position thereon by movement of the attachment surface on the spreader element towards and against the support surface on the support bar and for releasing the spreader element and separating the spreader element from the support bar by movement of the attachment surface on the spreader element away from the support surface on the support bar.

15 Claims, 2 Drawing Sheets

FIG.3
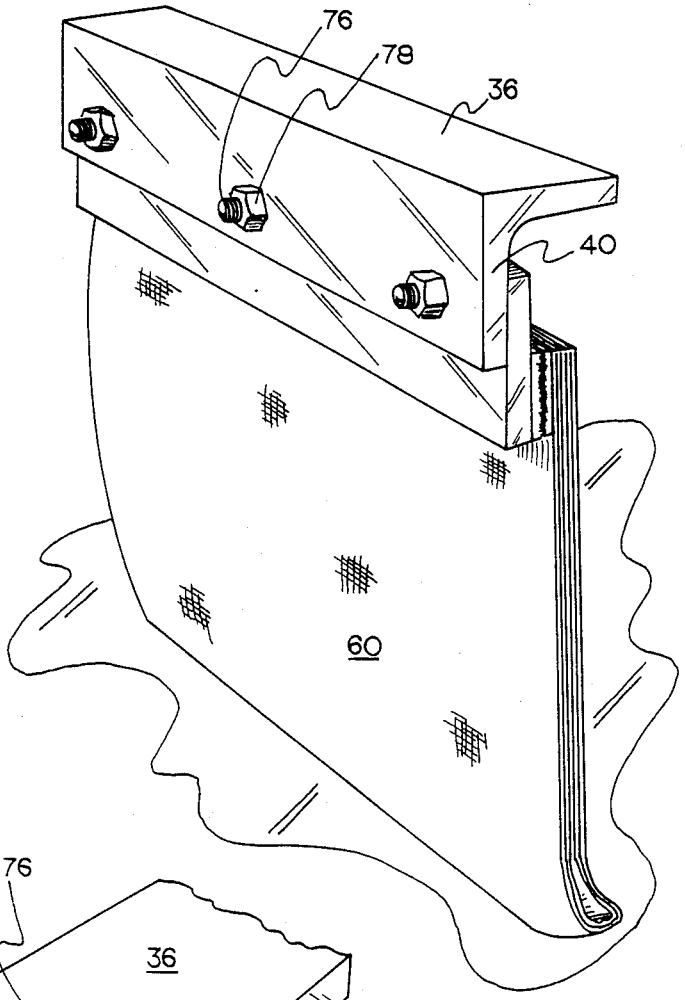
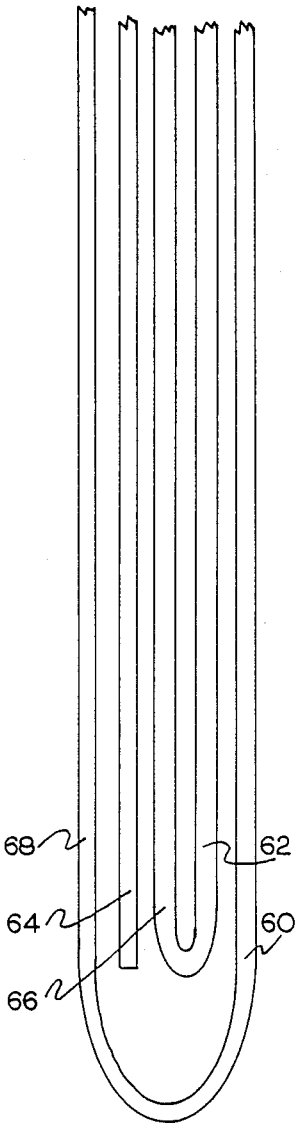
FIG.4
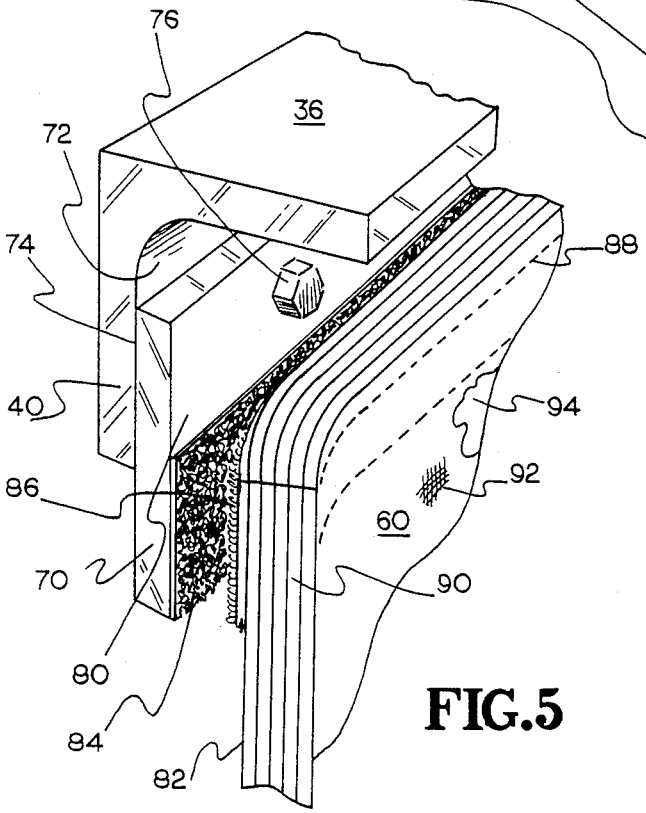
FIG.5

SPREADER ATTACHMENT APPARATUS

FIELD OF THE INVENTION

This invention relates to ice resurfacing machines and, more particularly, to an apparatus for evenly distributing liquid applied by those machines to a subjacent surface.

BACKGROUND OF THE INVENTION

Periodically, ice rinks require resurfacing to allow for continued safe and effective use. The action of skating places substantial stresses on the ice. Chipping, scoring, and shaving buildup reduce the quality of the ice, and consequently the quality of the skating.

Resurfacing of ice rinks is normally carried out by use of a rather sophisticated ice resurfacing machine, such as that manufactured by Resurfacice Corp. of St. Jacobs, Ontario, and identified as its Olympia Model ST75. Ice resurfacing machines, such as the Model ST75, typically shave off a top layer of the ice with a large blade and then apply a layer of heated water on the newly shaved ice to form a fresh, thin, top layer of ice. A spreader attached on the rear of the machine drags along the ice surface to evenly spread the applied layer of water so that the new layer of ice is level and of generally uniform thickness. There are a number of different types of spreaders with the flexible spreader towel being the most predominant.

The conventional method of attaching the spreader towel to the ice resurfacing machine is to secure the towel directly to a laterally extending rigid mounting bar on the ice resurfacing machine. To make the connection possible, the towel is provided with a row of bolt-receiving grommets, which are spaced at regular, relatively small intervals. The aforementioned Model ST75 uses 18 bolts to secure the towel. The large number of bolts is required to keep the flexible towel firmly in place and in a level hanging position across the lateral extent thereof.

Several problems arise with the use of the above attachment structure. Removal and/or replacement of the spreader is relatively time consuming due to the large number of bolts, which must be removed and reattached using tools on opposite sides of the mounting bar.

The nuts and bolts are also exposed to a wide range of temperatures and a wet environment. Between the ice, the ambient temperature, and the hot water currently used for resurfacing of ice, the nuts and bolts may experience a temperature range from 15° F. up to 150° F. and higher. This exposure may degrade the nuts and bolts, further inhibiting their removal.

Through use, spreaders become worn, shredded and torn—all of which conditions result in uneven water distribution and thereby poor, if not dangerous, ice conditions. Further, the towel may become saturated with water and/or have ice form in and on the towel. The saturation and ice build-up will adversely effect the spreader's efficiency, so as to warrant replacement.

The difficulty in removing and replacing the towel inevitably results in the spreader remaining in use longer than it should, which not only accounts for poor ice conditioning, but further aggravates both removal by permitting further rust buildup that may ultimately require that bolts be cut off and replaced.

Difficult to remove spreaders also cause problems apart from their liquid spreading function. The spreader towels can be used for advertising—the rear surface of the towel is exposed to view and can be printed upon. The ice resurfacing machines are viewed by large numbers of spectators at professional hockey games, ice skating shows, and the like, thereby serving as a valuable advertising medium.

Because it is difficult to replace spreader towels, a considerable amount of advertising revenue is lost by reason of advertising space not being utilized. Further, with advertisements on conventional towels that are in place too long, the message and/or towel may deteriorate to the point of becoming unsightly, which is a disservice to advertisers.

A still further problem with prior spreader towels is that they are difficult to manufacture. That is, the grommets must be built into the towel. The manufacturer must inventory the grommets and the assembly thereof increases both the manufacturing time and attendant costs.

SUMMARY OF THE INVENTION

It is a principal object of the present invention to provide an improved spreader attachment for an ice resurfacing machine wherein removal and/or replacement is relatively simple and can be accomplished without the use of tools.

According to the invention, a spreader attachment is provided for an ice resurfacing machine of the type having a front and rear, a laterally extending conditioning housing with a rigid frame portion to be positioned in close proximity to a subjacent surface to be treated and having associated means for delivering water from a supply against a subjacent surface, and structure for propelling the housing across a subjacent surface to be treated. The spreader attachment consists of an elongate support bar secured to the rigid frame portion so that the length of the support bar is substantially horizontally situated along the lateral extent of the housing with the support bar having a laterally extending support surface, a spreader element with an attachment surface for engagement with a subjacent surface to distribute water from the supply evenly on a subjacent surface across the lateral extent of the housing as the housing is moved, and cooperating structure on the spreader element and support bar for releasably attaching the spreader element to the support bar in operative position thereon by movement of the attachment surface on the spreader element towards and against the support surface on the support bar and for releasing the spreader element and separating the spreader element from the support bar by movement of the attachment surface on the spreader element away from the support surface on the support bar.

With the inventive structure, the spreader attachment can be simply assembled by aligning the spreader element on the housing and pressing the same against the support bar. Removal of the spreader element is accomplished by reversing this step.

Because of the ease of assembly and disassembly of the spreader element, users of ice resurfacing equipment are more inclined to periodically change the spreader element. This results in improved ice conditions and resultingly safer skating. Further, the spreader element, which has a relatively large surface exposed for viewing at the rear of the ice resurfacing machine, can conveniently carry an advertisement. Whereas with the conventional spreader element, it has been necessary to remove numerous, and commonly 17 or more bolts, to effect removal and reassembly thereof, it is possible with the inventive structure to draw the spreader element off and replace it with a different element in a matter of seconds. It is thus possible for advertisements to be changed several times during the course of an event, such as hockey game, at which the ice resurfacing machine is viewed by large numbers of spectators.

The cooperating structure on the spreader element and support bar may take any of a number of different forms. For example, cooperating magnets, VELCRO-type strips, etc. can be utilized. It is only necessary that the attraction between the spreader element and support bar be sufficient to hold the spreader attachment in a relatively fixed position during operation of the ice resurfacing machine.

In a preferred form, the spreader element is a towel, which is folded against itself to define a plurality of layers. The invention contemplates that the cooperating structure for attaching the spreader towel can be secured, as by stitching to the towel, which stitching also maintains the towel in a folded state.

In one form of the invention, the support bar consists of a piece of angle iron with a depending leg and a rigid strap, secured to the leg. The strap has a rearwardly facing flat surface to which the attaching structure cooperating with the structure on the spreader element can be attached. In one form, the rigid strap is secured by bolts to the depending angle iron leg.

DETAILED DESCRIPTION OF THE DRAWINGS

FIG. 3 is a fragmentary, perspective view of a spreader attachment according to the present invention and consisting of a mounting bar and spreader towel;

FIG. 4 is an enlarged, side elevation view of the spreader towel on the spreader attachment of FIG. 3; and FIG. 5 is a perspective view of the spreader attachment of FIG. 3 with the spreader towel partially separated from the mounting bar.

DESCRIPTION OF THE PREFERRED EMBODIMENT

Figure 1:
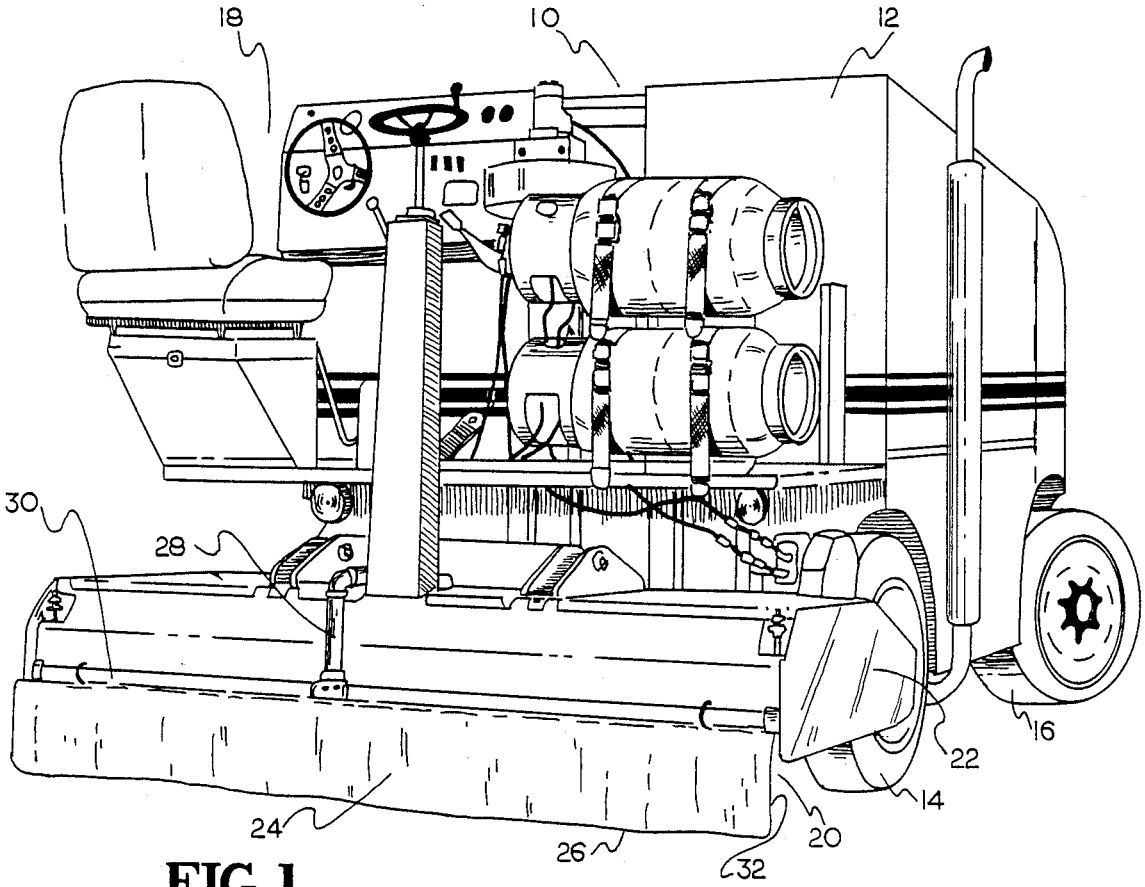
FIG.1 (PRIOR ART)
FIG. 1 is a rear perspective view of a prior art ice resurfacing machine with a conventional water spreader attachment.
Figure 2:
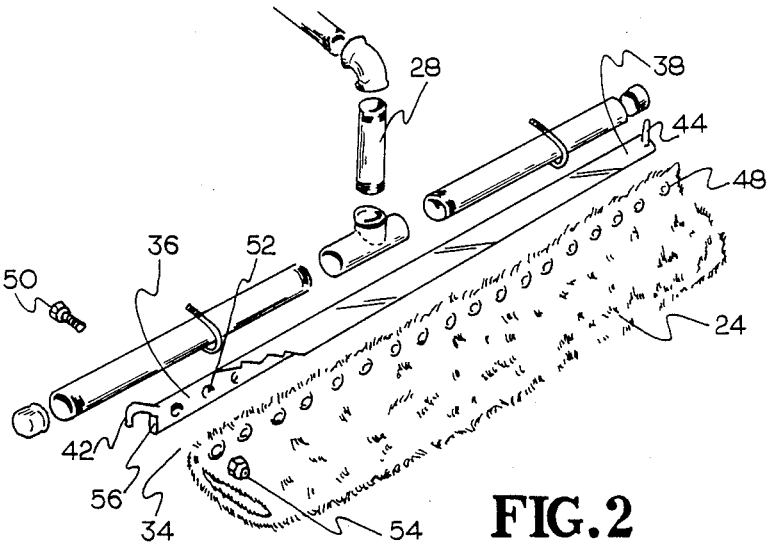
FIG.2 (PRIOR ART)
FIG. 2 is an exploded perspective view of the spreader attachment in FIG. 1.

A prior art ice resurfacing machine, with which the present invention can be utilized, is shown in FIGS. 1 and 2 at 10. The depicted machine 10 is manufactured by Resurfacice Corp. of St. Jacobs, Ontario, and identified as their Model ST75.

The ice resurfacing machine 10 has a main chassis 12 supported for movement on a pair of rear wheels 14 (one shown) and a pair of steerable front wheels 16 (one shown). A suitable power source (not shown) propels the machine 10. All operating functions of the machine 10 are controlled by an individual seated at an operator's station at 18.

The most significant portion of the machine 10, in terms of the present invention, is the conditioning section at 20. The conditioning section 20 consists of a rigid housing 22, defining an internal shrouded space in which water is controllably delivered to a subjacent surface to be treated. The focus of the description herein will be on the conditioning section 20.

The housing 22 can be selectively raised and lowered by the operator. In FIG. 1, the housing 22 is shown in an elevated position. In the elevated housing position, a flexible spreader element 24, which extends along the lateral extent of the housing 22, hangs freely with its lower edge 26 slightly elevated above the subjacent surface on which the machine 10 is supported.

During a resurfacing operation, in addition to sweeping, scraping, etc., the machine 10 is used to spread a thin layer of water over the subjacent, cooled surface to produce a thin, top layer of ice. To accomplish this, the housing 22 is lowered and a supply of water is delivered through a conduit 28 to a manifold 30 through which water is distributed in an even stream across the lateral extent of the housing 22. With the housing 22 lowered, the forwardly facing surface 32 of the spreader element 34 lays facially against the subjacent surface. As the machine 10 moves, the spreader element 24 drags across the subjacent surface and causes the water to be evenly distributed in a thin layer on that surface.

The present invention is directed to the connection of the spreader element 24 to the housing 22. The details of the conventional spreader element connecting structure for the machine 10 are shown in FIG. 2. The spreader attachment, which is shown generally at 34 in FIG. 2, has a support bar 36, which is made from a length of angle iron. The support bar 36 has horizontal and vertical legs 38, 40, respectively and a length sufficient to substantially span the lateral extent of the housing 22. Hangers 42, 44 are provided at the opposite ends of the support bar 36 for connection of the bar 36 to a rigid frame portion on the housing 22.

The spreader element 24, in FIG. 2, is a folded cloth material, such as terry cloth. At the top of the folded cloth 24 are a plurality of grommets 48, each dimensioned for the reception of a single bolt 50. The grommets 48 in the cloth 24 are aligned with a corresponding number of bolt-receiving bores 52, equidistantly spaced along the lateral extent of the support bar 36.

Because it is important that the cloth 24 hang evenly on the support bar 36 so that the cloth 24 lays evenly on the subjacent surface being treated, it has been conventional to use a large number of bolts 50 and cooperating nuts 54 to retain the spreader element 24 on the support bar 36. In Par Equipment's Model ST75, eighteen bolts are utilized to secure the attachment 24 to the support bar 36. To assembly the spreader element 24 to the support bar 36, each bolt 50 is directed rearwardly through a bore 52 in a vertical leg 40 of the support bar 36 and through a grommet 48, with the free end of the bolt being secured by a nut 54.

There are numerous problems encountered in the assembly and disassembly of the element 24 in the FIG. 2 structure. First of all, the forwardly facing surface 56 of the vertical leg 40 of the support bar 36 is in close proximity to the housing 22. Thus, it is difficult to place the necessary tools to tighten the bolts 50 on the front side of the support bar 36. Also, the large number of bolts, even if they were accessible, require a significant amount of time to secure. Further, the bolts 50 are exposed to the water that is being used to resurface so that the bolts are prone to rusting. Once the bolts rust, the job of assembling and disassembling the spreader attachment 24 is aggravated to the point that it is often necessary to cut the bolts 50.

The present invention is shown in detail in FIGS. 3–5. A spreader towel 60 is shown to demonstrate the attachment of the spreader element 60 to the support bar 36, which can have the same configuration as that in FIG. 2. The spreader element/towel 60 consists of a plurality of cloth layers. A first length of cloth 62 is folded in the shape of a U, as seen clearly in FIG. 4. A single layer 64 is placed against one leg 66 of the first cloth length 62. A separate length 68 of cloth is folded in a U and surrounds both the folded first length 62 and adjacent layer 64. The cloth making up the towel 60 is sufficiently flexible that the cloth will conform readily to the subjacent surface as it is dropped thereagainst by lowering of the housing 22.

The towel 60, configured as shown in FIGS. 3–5, is secured, according to the invention, either directly to the vertical leg 40 of the support bar 36 or through an intermediate rigid strap 70, as shown in FIGS. 3 and 5. If the rigid strap 70 is utilized, it is attached to the rearwardly facing surface 72 by facially abutting a flat, forwardly facing surface on the strap 70 to the rearwardly facing leg surface 72 and securing this connection as by bolts 76 and cooperating nuts 78. With the strap 70 attached to the support bar 36, a rearwardly facing, flat support surface 80 on the strap 70 is exposed to view at the rear of the housing 22, so as to be readily accessible to an installer of the spreader towel 60.

The present invention contemplates the provision of cooperating fastener parts on the strap surface 80 and forwardly facing attachment surface 82 of the spreader towel 60. In the embodiment shown, a VELCRO-type fastener is employed. A loop fastener 84, in the form of a strip, is adhesively, or otherwise, secured to the rearwardly facing support surface 80 on the strap 70. A hook fastener 86, which cooperates with the loop fastener 84, is also in the form of a strip and is secured to the forwardly facing attachment surface 82 of the towel 60. Connection of the hook fastener 86 to the towel 60 is accomplished by one or more laterally extending rows of stitching 88. The stitching extends through the strip hook fastener 86 and the five towel layers so that the stitching serves the dual purpose of maintaining the towel in its desired folded state and securing the hook fastener 86 to the towel 60. It should be understood that the hook and loop fastener strips 86, 84, respectively, can be interchanged consistent with the present invention.

It is thus possible to assemble the towel 60 by simply placing the towel 60 behind the strap 70 and pressing the hook fastener strip 86 firmly forwardly against the loop fastener strip 84 on the rigid strap 70. Preferably, the strips of hook and loop fasteners 86, 84 respectively, extend over substantially the entire lateral extent of the support bar 36. This accounts for a firm connection of the spreader towel 60 to the support bar 36.

To remove the spreader towel 60, all that is required is that one grab the edge of the towel 60, as for example at edge 90 in FIG. 5, and draw the towel rearwardly away from the support bar 36 and strap 70. The towel 60 can then be cleaned, repaired, and/or replaced by a similar towel 60.

The towel 60 can be simply and economically manufactured with the fastener 86 being an integral part thereof. The rearwardly facing surface 92 of the towel 60 provides a space for advertising, shown schematically at 94. Within a matter of seconds, the towels 60 can be changed, to thereby vary the advertisement 94 on the exposed portion of the towel 60.

The invention contemplates several variations of the embodiment in FIGS. 3–5. For example, the strap 70 can be eliminated altogether and the fastener strip 84 can be secured directly to the surface 72 on the support bar 36.

Further, the type of fastener used may be different than that shown in FIGS. 3–5. For example, magnets could be provided on one of the towel 60 and strap 70 to attract a metal element on the other of the towel 60 and strap 70. The important aspect of the fasteners is that they permit assembly and disassembly of the towel 60 by simply pressing the towel 60 against the strap 70 or supporting bar 36 and removal of the towel 60 by drawing the towel 60 rearwardly away from the support bar 36 or strap 70. There is no need to utilize any tools to effect assembly or disassembly of the towel 60.

The foregoing disclosure of specific embodiments is intended to be illustrative of the broad concepts comprehended by the invention.

I claim:

1. A spreader attachment for an ice resurfacing machine of the type having a front and rear, a laterally extending housing with a rigid frame portion to be positioned in close proximity to a subjacent surface to be treated and having associated means for delivering water from a supply against a subjacent surface, and means for moving the housing across a subjacent surface to be treated, said spreader attachment comprising:

an elongate support bar;

means for securing the support bar to the rigid frame portion so that the length of the support bar is substantially horizontally situated along the lateral extent of the housing, said support bar having a laterally extending support surface;

a spreader element with an attachment surface for engagement with a subjacent surface to distribute water from said supply evenly on a subjacent surface across the lateral extent of the housing as the housing is moved; and cooperating means on the spreader element and support bar for releasably attaching the spreader element to the support bar in operative position thereon by movement of the attachment surface on the spreader element towards and against the support surface on the support bar and for releasing the spreader element and separating the spreader element from the support bar by movement of the attachment surface on the spreader element away from the support surface on the support bar.

2. The spreader attachment according to claim 1 wherein the support bar has a piece of angle iron with transverse legs and one of the angle iron legs has a rearwardly facing flat surface to which the spreader element attaches.

3. The spreader attachment according to claim 2 including a rigid strap with a flat surface and means for attaching the rigid strap to the one angle iron leg so that the flat strap surface faces rearwardly of the ice resurfacing machine and the cooperating means on the support bar is on the flat strap surface.

4. The spreader attachment according to claim 1 wherein the spreader element comprises a cloth towel.

5. The spreader attachment according to claim 4 wherein said cooperating means comprises cooperating VELCRO-type fastener elements on the spreader element and support bar.

6. The spreader attachment according to claim 3 including means for releasably attaching the rigid strap to the one angle iron leg.

7. The spreader attachment according to claim 5 wherein one of said VELCRO-type elements is sewn directly to the cloth towel.

8. The spreader attachment according to claim 6 wherein the means for releasably attaching the rigid strap comprises a plurality of releasable fasteners.

9. The spreader attachment according to claim 8 wherein said fasteners are bolts.

10. The spreader attachment according to claim 7 wherein the cloth towel is folded against itself to provide a plurality of layers and stitching is provided through the one VELCRO-type element and a plurality of the towel layers so that the stitching serves the dual purpose of maintaining the towel in a folded state and securing the one VELCRO-type element to the towel.

11. A spreader attachment for an ice resurfacing machine of the type having a front and rear, a laterally extending housing with a rigid frame portion to be positioned in close proximity to a subjacent surface to be treated and having associated means for delivering water from a supply against a subjacent surface, and means for moving the housing across a subjacent surface to be treated, said spreader attachment comprising:

an elongate support bar;

means for securing the support bar to the rigid frame portion so that the length of the support bar is substantially horizontally situated along the lateral extent of the housing, said support bar having a depending leg with forwardly and rearwardly facing surfaces, said forwardly facing surface being in close proximity to the housing with the support bar secured to the rigid frame portion so as to impede the placement of tools between the forwardly facing surface and the housing, said support bar having a laterally extending support surface;

a spreader element with an attachment surface for engagement with a subjacent surface to distribute water from said supply evenly on a subjacent surface across the lateral extent of the housing as the housing is moved; and cooperating means on the spreader element and support bar for releasably attaching the spreader element to the support bar in operative position thereon by movement of the attachment surface on the spreader element towards and against the support surface on the support bar and for releasing the spreader element and separating the spreader element from the support bar by movement of the attachment surface on the spreader element away from the support surface on the support bar.

12. The spreader attachment according to claim 11 wherein said support bar consists of at least two pieces, one said support bar piece consisting of a piece of angle iron with a leg extending vertically with said support bar secured to the rigid frame portion and the other said support bar piece being a rigid strap with oppositely facing flat surfaces, and means are provided for securing one said flat strap surfaces against the vertically extending angle iron leg so that the other flat strap surface faces substantially rearwardly and is exposed at the rear of the housing.

13. The spreader attachment according to claim 12 wherein the cooperating means on the support bar comprises means on the other flat strap surface.

14. The spreader attachment according to claim 13 wherein the spreader element comprises a cloth towel that is folded against itself to provide a plurality of layers, and the cooperating means on the cloth towel is stitched to the towel and through a plurality of the towel layers so that the stitching serves the dual purpose of maintaining the towel in a folded state and securing the cooperating means on the towel to the towel.

15. The spreader attachment according to claim 11 wherein with the spreader element attached to the support bar, a surface on the spreader element is exposed to view at the rear of the ice resurfacing machine and an advertisement is placed on the exposed surface of the spreader element.

* * * * *